US008292585B2

(12) United States Patent
Liu

(10) Patent No.: US 8,292,585 B2
(45) Date of Patent: Oct. 23, 2012

(54) FAN DEVICE HAVING SIMULTANEOUSLY FOLDABLE BLADES

(75) Inventor: Ching-Wen Liu, Taichung County (TW)

(73) Assignee: Pan Air Electric Co., Ltd., Taichung (TW)

( * ) Notice: Subject to any disclaimer, the term of this patent is extended or adjusted under 35 U.S.C. 154(b) by 429 days.

(21) Appl. No.: 12/779,055

(22) Filed: May 13, 2010

(65) Prior Publication Data

US 2011/0280711 A1 Nov. 17, 2011

(51) Int. Cl.
*F04D 29/18* (2006.01)
*F04D 29/26* (2006.01)

(52) U.S. Cl. ..... 416/143; 416/5; 416/87; 416/140; 416/142

(58) Field of Classification Search ..... 415/130; 416/5, 87, 131, 135, 139, 140, 142, 143, 416/194, 204 R, 205, 206, 210 R; 417/410.1; D23/411, 413
See application file for complete search history.

(56) References Cited

U.S. PATENT DOCUMENTS

| | | | | |
|---|---|---|---|---|
| 1,445,402 | A * | 2/1923 | Le Velle | 416/87 |
| 2,079,942 | A * | 5/1937 | Le Velle | 416/87 |
| 7,153,100 | B2 * | 12/2006 | Frampton et al. | 416/5 |
| 8,092,180 | B2 * | 1/2012 | Liu | 416/142 |
| 2012/0045331 | A1 * | 2/2012 | Villella | 416/5 |

* cited by examiner

*Primary Examiner* — Patricia Bianco
*Assistant Examiner* — Christopher J Hargit

(57) ABSTRACT

A fan device having simultaneously foldable blades includes a rotatable driving unit. A plurality of supporting frames extend outwardly from the driving unit, each supporting frame has a pivot mounted on one end thereof. A plurality of shells are respectively mounted on the supporting frames, each shell has a center hole defined therein. A plurality of blades are respectively disposed on the shells. Each blade has an assembling portion disposed thereon. Each assembling portion has a through hole defined therein. A plurality of coupling rods respectively positioned between every two adjacent shells. When the driving unit rotates, the shells synchronously rotate and driving the coupling rods to be moved for simultaneously driving the blades to retractably fold/unfold.

4 Claims, 5 Drawing Sheets

FAN DEVICE HAVING SIMULTANEOUSLY FOLDABLE BLADES

BACKGROUND OF THE INVENTION

1. Field of the Invention

The present invention relates to fan device, and more particularly to a fan device which has simultaneously foldable blades.

2. Description of Related Art

Ceiling fans are widely used in many households today as ceiling fans are extremely useful and convenient to circulate air within a closed space.

A conventional ceiling fan includes a plurality of fan blades secured to a rotatably driven outer portion of the motor assembly. The motor assembly is surrounded by a housing including top and bottom plates in a clamped engagement with an annular translucent panel, disposed peripherally between the plates, and including an annular fluorescent light bulb disposed within the housing in a surrounding relation to the motor assembly, including a support structure to hold the light bulb in a generally central position between the plates.

However, despite the advantages and effects it provides, the conventional ceiling fan has some drawbacks: for instance, the fan blades are secured to the outer portion of the motor assembly for simultaneously rotating with the motor assembly to provide an air ventilating effect when in operation. When the ceiling fan is not in operation mode, the fan blades remained in a spread-opened state. However, the ceiling fan may not be used all year round, when the ceiling fan is not used for a certain period of time, the spread-opened fan blades not only occupies a lot of space, but may also influences the aesthetical appearance. In addition, the fan blades are easily worn when the fan blades are remained spread-opened but not used for a long period of time.

The present invention has arisen to obviate/mitigate the disadvantages of the conventional fan devices.

SUMMARY OF THE INVENTION

The present invention relates to a fan device having simultaneously foldable blades which comprises a rotatable driving unit, a plurality of supporting frames extend outwardly from the driving unit, a plurality of shells are respectively rotatably mounted on the supporting frames, a plurality of blades are respectively disposed on the shells, and a plurality of coupling rods are respectively positioned between every two adjacent shells. Each supporting frame has a pivot mounted on one end thereof and extending upwardly therefrom. Each shell has a center hole defined therein for receivably engaging with the pivot of the corresponding supporting frame. A plurality of bores are annularly defined in the shell such that the center hole is encircled by the bores. Each blade has an assembling portion disposed on one end thereof for assembling with a corresponding shell. Each assembling portion has a through hole defined therein for receivably engaging with a corresponding pivot such that the blade is pivotally rotatable relative to the supporting frame. A plurality of securing holes are annularly defined in the assembling portion, the securing holes of each blade are correspondingly and vertically aligned with the bores of the corresponding shell.

Each coupling rod includes an arcuate main section and two arcuate connecting sections which are integrally and respectively formed on two ends of the main section. The main section of the coupling rod is oppositely arched relative to the two connecting sections of the coupling rod. Each connecting section has an arcuate shape corresponding to a periphery of the shell for preventing the connecting section from colliding with the pivot of the supporting frame when operating. Each connecting section has a penetrating hole defined therein and corresponding to any one of the bores of the shell. The two connecting sections of each coupling rod are respectively pivotally connected to the two corresponding adjacent shells. A securing bolt passes through the aligned penetrating hole, the securing hole and the bore for securely assembling the coupling rod, the shell, and the blade.

When the driving unit rotates, the supporting frames are synchronously rotated with the driving unit and driving the shells to simultaneously rotate, the shells rotatably driving the coupling rods to be pivotally moved relative to the supporting frames for simultaneously driving the blades to retractably fold/unfold.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
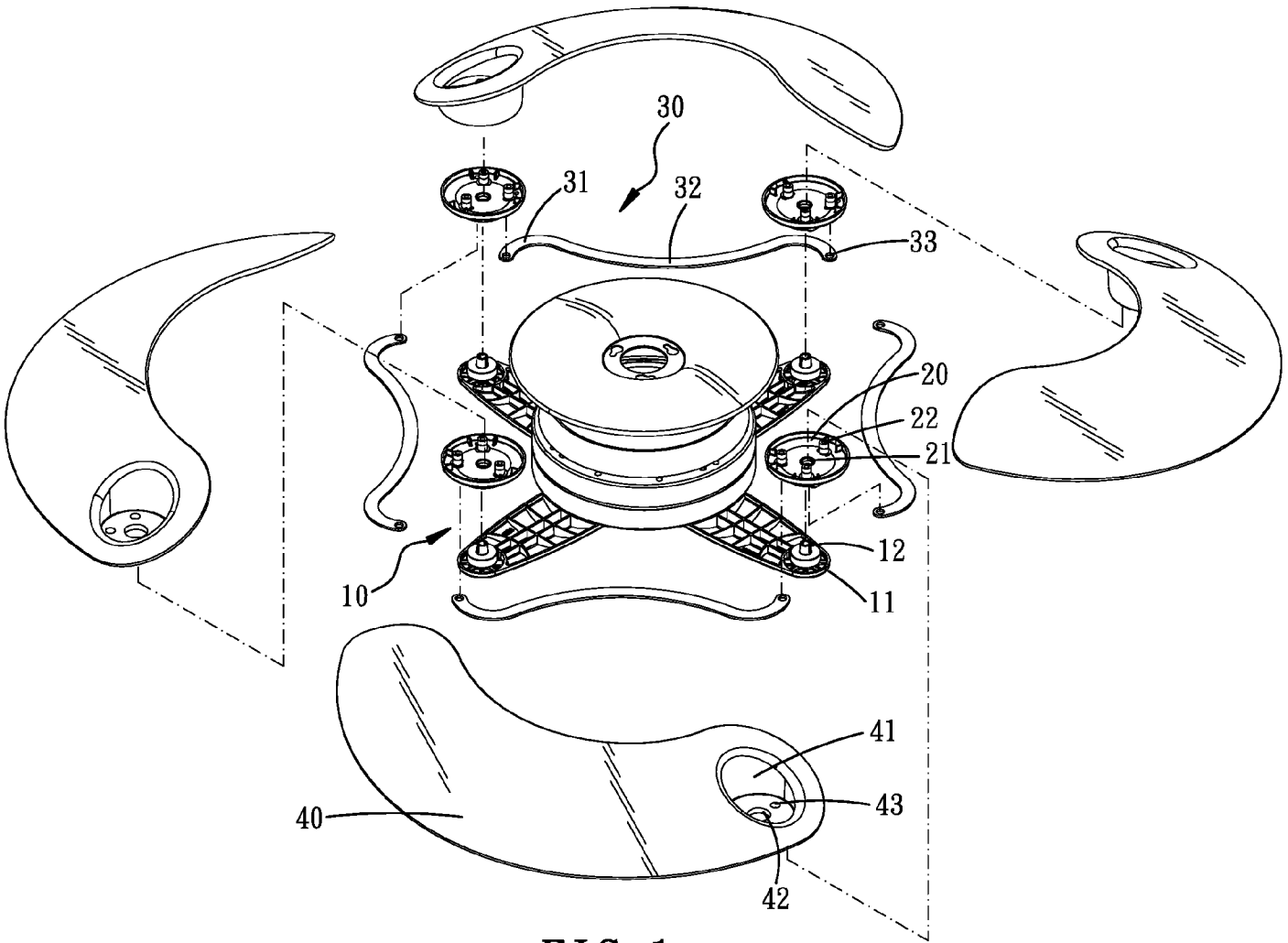
FIG. 1 is an exploded perspective view of the fan device having simultaneously foldable blades in accordance with the present invention.
Figure 2:
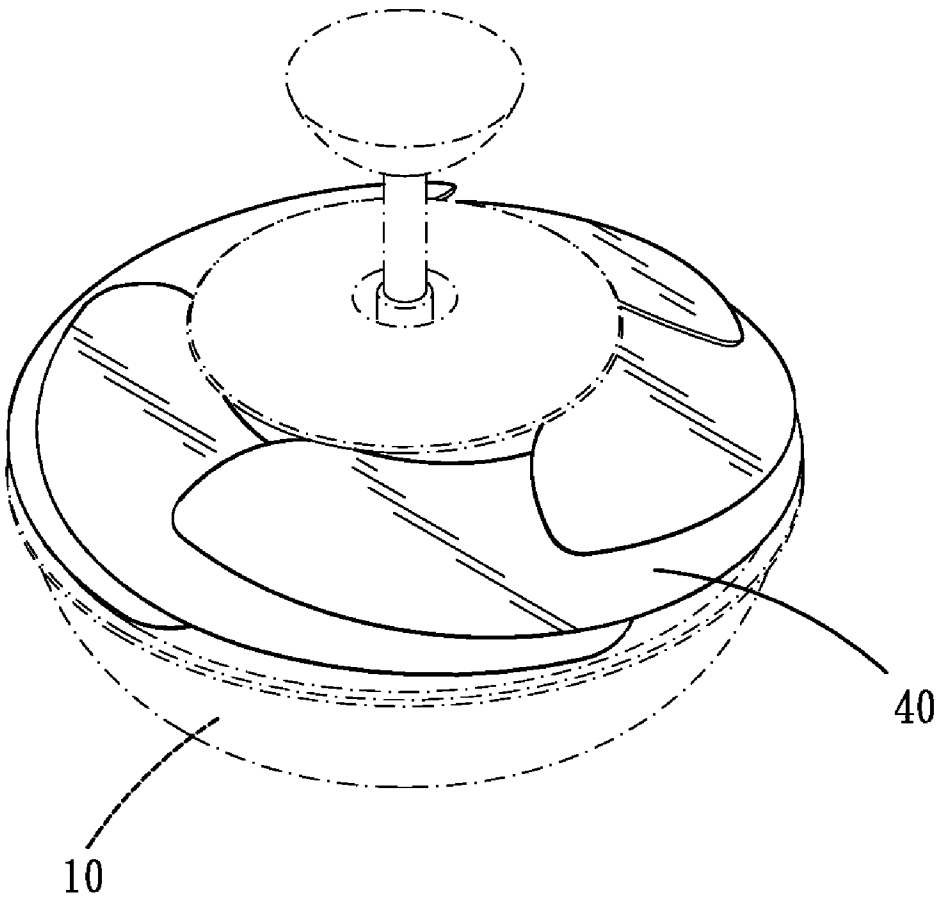
FIG. 2 is an assembled perspective view of the fan device having simultaneously foldable blades in accordance with the present invention; wherein the blades are in a folded state.
Figure 3:
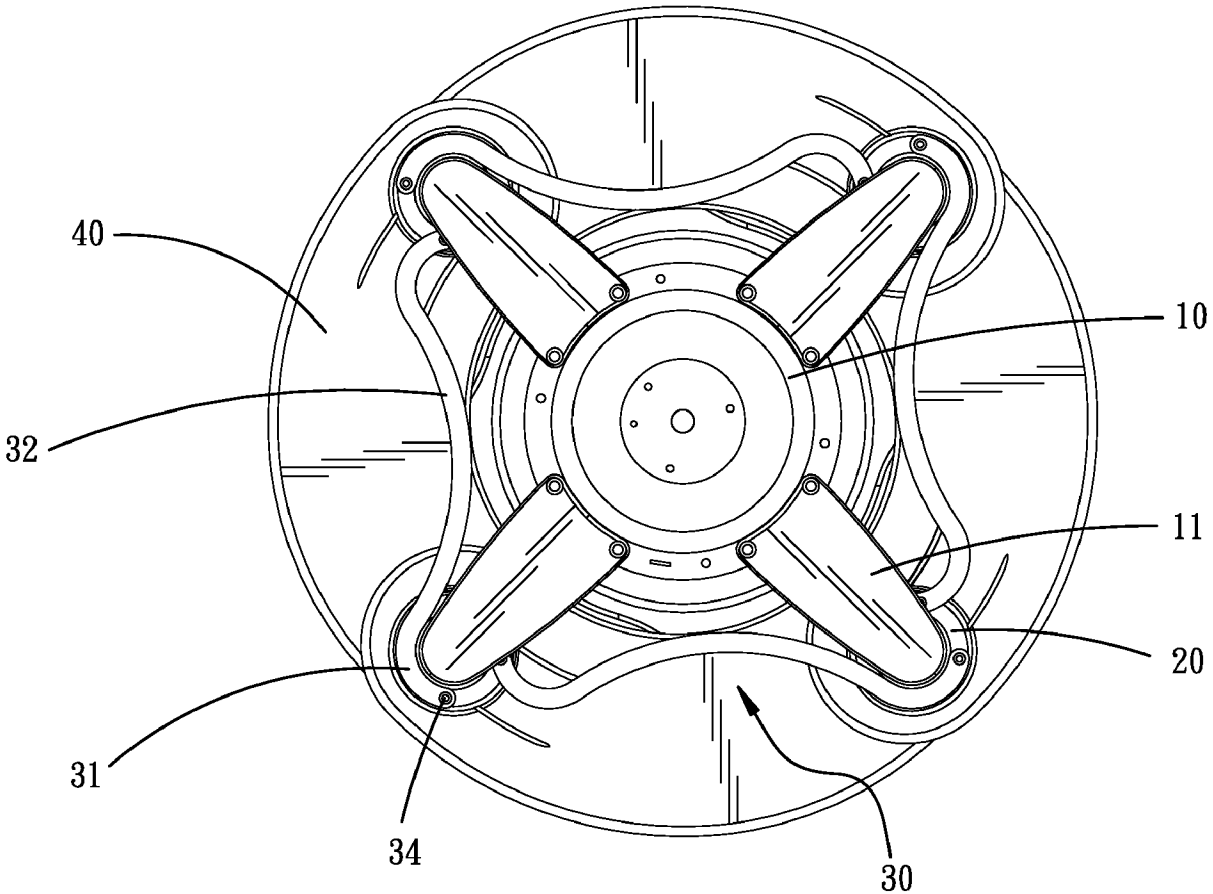
FIG. 3 is a bottom plane view of the assembled fan device having simultaneously foldable blades in accordance with the present invention; wherein the blades are shown in a folded state.

Referring to the drawings and initially to FIGS. 1-3, a fan device having simultaneously foldable blades in accordance with the present invention comprises a rotatable driving unit 10 which has a generally rounded configuration. Four supporting frames 11 extend radially and outwardly from the driving unit 10. Each supporting frame 11 has a pivot 12 which is mounted on one end thereof and extending upwardly therefrom. Four shells 20 are rotatably respectively mounted on the four supporting frames 11. The shells 20 are disc-shaped. Each shell 20 has a center hole 21 defined therein for receivably engaging with the pivot 12 of the corresponding supporting frame 11. Three bores 22 are annularly defined in an inner periphery of the shell 20 such that the center hole 21 is encircled by the bores 22. Four blades 40 are respectively disposed on the four shells 20. Each blade 40 has an assembling portion 41 which is disposed on one end thereof for assembling with the corresponding shell 20. The assembling portion 41 protrudes from a bottom surface of the blade 40. Each assembling portion 41 has a through hole 42 defined therein for receivably engaging with the pivot 12 of the corresponding supporting frame 11. Three securing holes 43 are annularly defined in an inner periphery of the assembling portion 41 of the blade 40 such that the through hole 42 is encircled by the securing holes 43. The three securing holes 43 are correspondingly vertically aligned with the three bores 22 of the shell 20.

Figure 4:
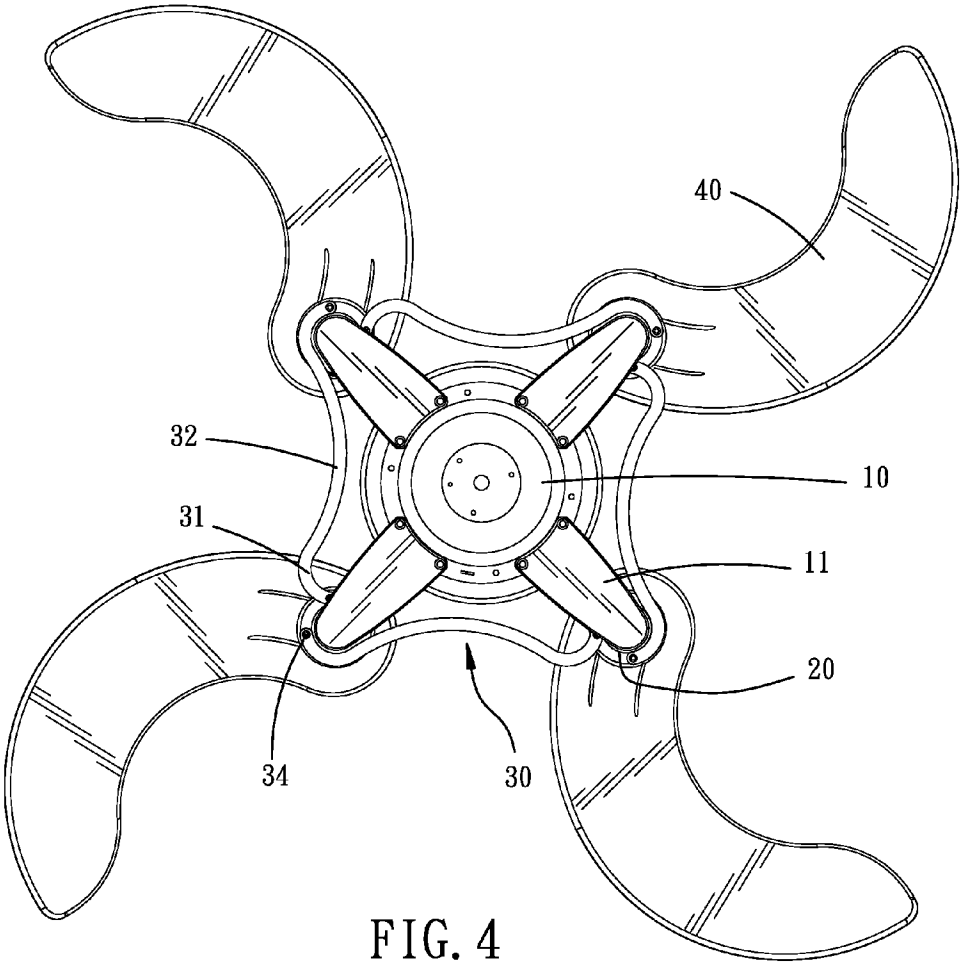
FIG. 4 is another bottom plane view of the assembled fan device having simultaneously foldable blades in accordance with the present invention; wherein the blades are shown in an unfolded state.

Four coupling rods 30 are respectively positioned between every two adjacent shells 20. Two ends of each coupling rod 30 are respectively pivotally connected to the two adjacent shells 20. Each coupling rod 30 has an arcuate main section 32 and two arcuate connecting sections 31 integrally and respectively formed on two ends of the main section 32. The main section 32 of the coupling rod 30 is oppositely arched relative to the two connecting sections 31. Each connecting section 31 has a penetrating hole 33 defined therein. The penetrating hole 33 of the connecting section 31 corresponds to any one of the bores 22 of the shell 20 for the connecting section 31 to pivotally engage with the shell 20, such that a rotation of the shell 20 would drive the coupling rod 30 to slightly pivotally move relative to the supporting frame 11. Each connecting section 31 has an arcuate shape which corresponds to a periphery of the shell 20, such that the connecting section 31 of the coupling rod 30 is prevented from colliding with the pivot 12 of the supporting frame when operating (as shown in FIG. 3 and FIG. 4).

A securing bolt 34 passes through the aligned penetrating hole 33, securing hole 43, and the bore 22, such that the coupling rod 30, the blade 40, and the shell 20 are securely assembled together by the securing bolt 34 for synchronous movement during operation. The shells 20 and the blades 40 are rotatable relative to the supporting frames 11 of the driving unit 10 and the coupling rods 30 are driven to pivotally move relative to the shells 20 by rotations of the shells 20 (operation of the present invention will be further described in details hereinafter).

Figure 5:
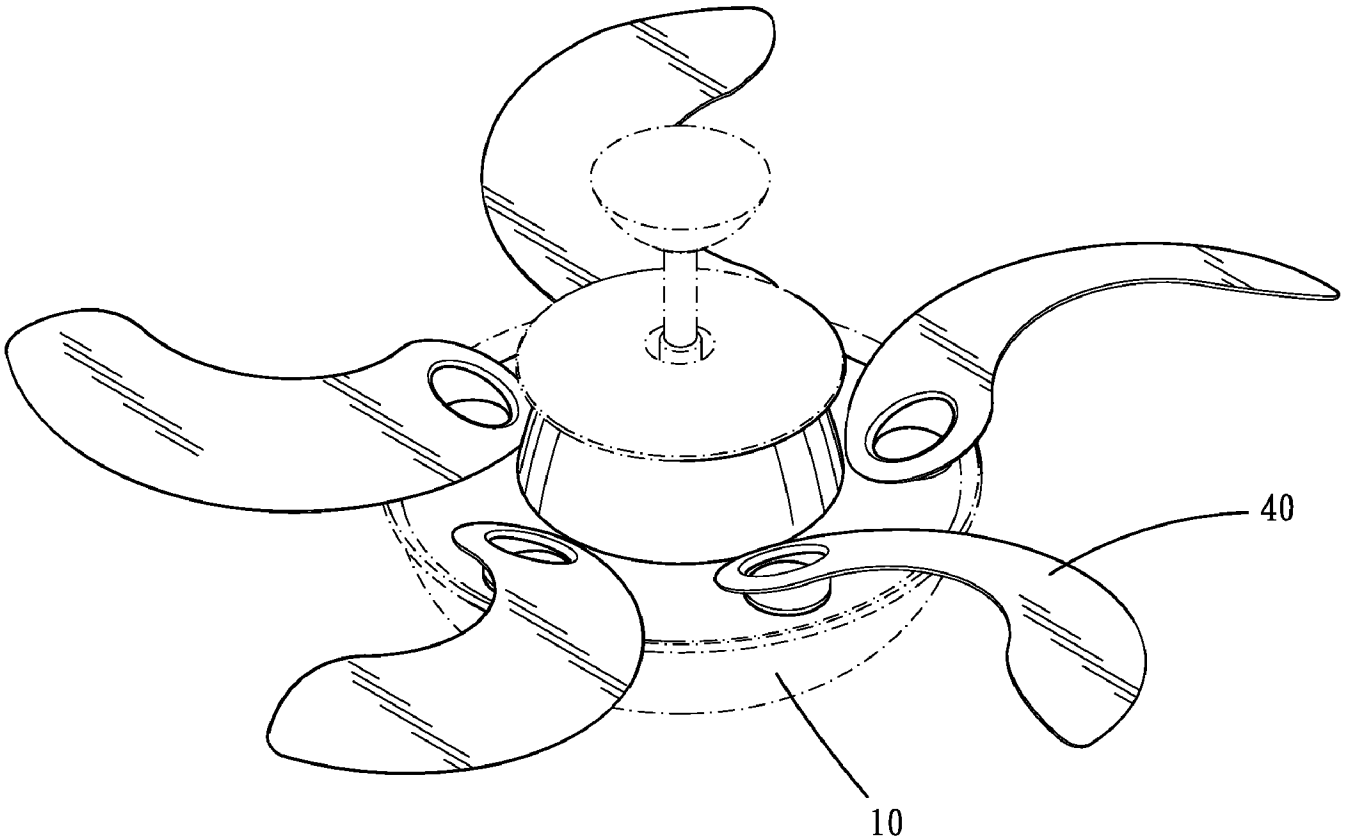
FIG. 5 is another assembled perspective view of the fan device having simultaneously foldable blades in accordance with the present invention; wherein the blades are shown in an unfolded state.

Further referring to FIG. 2 to FIG. 5, operation of the fan device having simultaneously foldable blades in accordance with the present invention will be described in detailed below. In an initial non-operating state, as shown in FIGS. 2 and 3, the blades 40 are inwardly retractably folded, the blades 40 are folded in such a way that each blade 40 overlaps one another and the folded blades 40 configure a generally circular shape such that the driving unit 10 is annularly enclosed by the blades 40, therefore when the blades 40 are folded, the fan device occupies very little space for easy storage and provides an aesthetical effect to an appearance of the fan device. In an operating state, the driving unit 10 is actuated to rotate, the four supporting frames 11 synchronously rotate with the driving unit 10. The four shells 20, which are rotatably mounted on the supporting frames 11, simultaneously rotate with the supporting frames 11, thereby the connecting sections 31 of the coupling rods 30 are rotatably driven by rotations of the shells 20, such that the connecting sections 31 are guided to move along tip peripheries of the supporting frames 11, whereby movements of the connecting sections 31 of the coupling rods 30 and a centrifugal force produced by rotation of the driving unit 10 drives the blades 40 to rotatably spread-open simultaneously to an unfolded state (as shown in FIG. 4 and FIG. 5). When the driving unit 10 is dis-actuated, a rotation speed of the driving unit 10 is gradually decreased; the shells 20 likewise rotate with the supporting frames 11 of the driving unit 10, the connecting sections 31 of the coupling rods 30 likewise are guided by the rotations of the shells 20 to move along the tip peripheries of the supporting frames 11 and drive the blades 40 to retractably fold inward, such that when the driving unit 10 is halted from rotation, the blades 40 are inwardly folded as in the initial non-operated state described above.

Although the invention has been explained in relations to its preferred embodiment, it is to be understood that many other possible modifications and variations can be made without departing from the spirit and scope of the invention as hereinafter claimed.

What is claimed is:

1. A fan device having simultaneously foldable blades comprising:

a rotatable driving unit, a plurality of supporting frames extending outwardly from the driving unit, each supporting frame having a pivot mounted on one end thereof and extending upwardly therefrom;

a plurality of shells respectively rotatably mounted on the supporting frames, each shell having a center hole defined therein for receivably engaging with the pivot of the corresponding supporting frame;

a plurality of blades respectively disposed on the shells, each blade having an assembling portion disposed on one end thereof for assembling with a corresponding shell, each assembling portion having a through hole defined therein for receivably engaging with a corresponding pivot such that the blade is pivotally rotatable relative to the supporting frame; and a plurality of coupling rods respectively positioned between every two adjacent shells, each coupling rod having two ends respectively pivotally connected to the two corresponding adjacent shells;

wherein when the driving unit rotates, the supporting frames synchronously rotated with the driving unit and driving the shells to simultaneously rotate, the shells rotatably driving the coupling rods to be pivotally moved relative to the supporting frames for simultaneously driving the blades to retractably fold/unfold.

2. The fan device having simultaneously foldable blades as claimed in claim 1, wherein each coupling rod includes an arcuate main section and two arcuate connecting sections integrally and respectively formed on two ends of the main section; each connecting section having an arcuate shape corresponding to a periphery of the shell for preventing the connecting section from colliding with the pivot of the supporting frame when operating.

3. The fan device having simultaneously foldable blades as claimed in claim 2, wherein the main section of the coupling rod is oppositely arched relative to the two connecting sections of the coupling rod.

4. The fan device having simultaneously foldable blades as claimed in claim 1, wherein each shell has a plurality of bores annularly defined therein such that the center hole is encircled by the bores; each blade having a plurality of securing holes annularly defined in the assembling portion thereof, the securing holes of each blade correspondingly and vertically aligned with the bores of the corresponding shell; each end of the coupling rod having a penetrating hole defined therein and corresponding to any one of the bores of the shell; the aligned penetrating hole, the securing hole and the bore having a securing bolt passing therethrough for securely assembling the coupling rod, the shell, and the blade.

* * * * *